US011286924B2

(12) United States Patent
Shirai et al.

(10) Patent No.: US 11,286,924 B2
(45) Date of Patent: Mar. 29, 2022

(54) CONTROL DEVICE OF ELECTRIC OIL PUMP AND ELECTRIC OIL PUMP

(71) Applicant: NIDEC TOSOK CORPORATION, Kanagawa (JP)

(72) Inventors: Yasuhiro Shirai, Kanagawa (JP); Koji Higuchi, Kanagawa (JP)

(73) Assignee: NIDEC TOSOK CORPORATION, Kanagawa (JP)

( * ) Notice: Subject to any disclaimer, the term of this patent is extended or adjusted under 35 U.S.C. 154(b) by 0 days.

(21) Appl. No.: 17/022,104

(22) Filed: Sep. 16, 2020

(65) Prior Publication Data

US 2021/0095661 A1 Apr. 1, 2021

(30) Foreign Application Priority Data

Sep. 26, 2019 (JP) ..... JP2019-175184

(51) Int. Cl.

| | |
|---|---|
| ***F04B 49/06*** | (2006.01) |
| ***F04B 17/03*** | (2006.01) |
| ***F04B 49/20*** | (2006.01) |
| ***F04C 14/08*** | (2006.01) |

(52) U.S. Cl.

CPC ..... *F04B 49/06* (2013.01); *F04B 17/03* (2013.01); *F04B 49/20* (2013.01); *F04C 14/08* (2013.01)

(58) Field of Classification Search

CPC ..... F04B 17/00; F04B 17/03; F04B 49/00; F04B 49/06; F04B 49/065; F04B 49/10; F04B 49/103; F04B 49/20; F04B 49/02; F04C 28/08; F04C 14/00; F04C 14/08; F04D 15/0066; F04D 15/004

See application file for complete search history.

(56) References Cited

U.S. PATENT DOCUMENTS

| | | | | |
|---|---|---|---|---|
| 4,204,808 | A * | 5/1980 | Reese | G05D 16/2073 417/2 |
| 8,111,030 | B2 * | 2/2012 | Chiu | H02P 23/02 318/599 |
| 9,181,953 | B2 * | 11/2015 | Steger | F04D 15/0066 |
| 10,746,171 | B2 * | 8/2020 | Komori | F04B 49/20 |
| 2015/0077026 | A1 * | 3/2015 | Ito | B62D 5/0493 318/400.06 |
| 2018/0159452 | A1 * | 6/2018 | Eke | G05F 1/00 |

(Continued)

FOREIGN PATENT DOCUMENTS

JP 5834509 12/2015

*Primary Examiner* — Charles G Freay
*Assistant Examiner* — Chirag Jariwala
(74) *Attorney, Agent, or Firm* — JCIPRNET

(57) ABSTRACT

A control device is provided for controlling a rotation speed of an electric oil pump, including a motor and a pump mechanism connected to the motor, based on a command value input from a host device. The control device includes: a first calculator calculating a first duty value of current to be output to the motor based on a deviation between the command value and a rotation speed of the motor; a second calculator calculating a second duty value of current to be output to the motor based on a deviation between a current limit value of the motor and a current value of the motor; and a drive current determiner comparing the first duty value calculated by the first calculator and the second duty value calculated by the second calculator, and selecting the lower duty value as a duty value of current that drives the motor.

5 Claims, 4 Drawing Sheets

(56) References Cited

U.S. PATENT DOCUMENTS

| | | | | |
|---|---|---|---|---|
| 2019/0136854 | A1* | 5/2019 | Watanabe | H02P 29/0241 |
| 2020/0018304 | A1* | 1/2020 | Sato | F04B 49/065 |
| 2020/0044586 | A1* | 2/2020 | Miyamoto | F04B 49/06 |
| 2020/0108809 | A1* | 4/2020 | Mizutani | B60T 8/4081 |
| 2020/0200166 | A1* | 6/2020 | Yamamoto | F04B 49/06 |

* cited by examiner

CONTROL DEVICE OF ELECTRIC OIL PUMP AND ELECTRIC OIL PUMP

CROSS-REFERENCE TO RELATED APPLICATIONS

The present invention claims priority under 35 U.S.C. § 119 to Japanese Application No. 2019-175184, filed on Sep. 26, 2019, the entire content of which is incorporated herein by reference.

FIELD OF THE INVENTION

The invention relates to a control device of an electric oil pump and an electric oil pump.

BACKGROUND

Conventionally, in the control devices of electric oil pumps used to supply hydraulic oil or cooling oil for vehicles, a control device that switches operation depending on an oil temperature is known.

However, to switch the operation based on the oil temperature, the conventional control device requires an oil temperature sensor and is therefore not applicable to an electric oil pump without an oil temperature sensor.

SUMMARY

According to an exemplary embodiment of the invention, a control device of an electric oil pump is provided for controlling a rotation speed of the electric oil pump, which includes a motor and a pump mechanism connected to the motor, based on a command value input from a host device. The control device of the electric oil pump includes: a first calculator calculating a first duty value of current to be output to the motor based on a deviation between the command value and a rotation speed of the motor; a second calculator calculating a second duty value of current to be output to the motor based on a deviation between a current limit value of the motor and a current value of the motor; and a drive current determiner comparing the first duty value calculated by the first calculator and the second duty value calculated by the second calculator, and selecting the lower duty value as a duty value of current that drives the motor.

The above and other elements, features, steps, characteristics and advantages of the present disclosure will become apparent from the following detailed description of the preferred embodiments with reference to the attached drawings.

DETAILED DESCRIPTION

An embodiment of the invention will be described with reference to the drawings. In each drawing, a Z-axis direction is a vertical direction with the positive side as the upper side and the negative side as the lower side. An axial direction of a central axis J appropriately shown in each drawing is parallel to the Z-axis direction, that is, the vertical direction. In the following description, the direction parallel to the axial direction of the central axis J is simply referred to as "axial direction". Further, a radial direction centered on the central axis J is simply referred to as "radial direction", and a circumferential direction centered on the central axis J is simply referred to as "circumferential direction".

In the present embodiment, the upper side corresponds to the other side in the axial direction and the lower side corresponds to the one side in the axial direction. In addition, "vertical direction", "horizontal direction", "upper side", and "lower side" are merely names to describe the relative positional relation between the parts, and the actual configuration relation and the like may be any configuration relation other than the configuration relation indicated by these names.

An electric oil pump 1 of the present embodiment is mounted, for example, in a drive device of a vehicle. In other words, the electric oil pump 1 is mounted in a vehicle. In the drive device of the vehicle, for example, the electric oil pump 1 sucks and discharges cooling oil circulating in a housing of the drive device.

Figure 1:
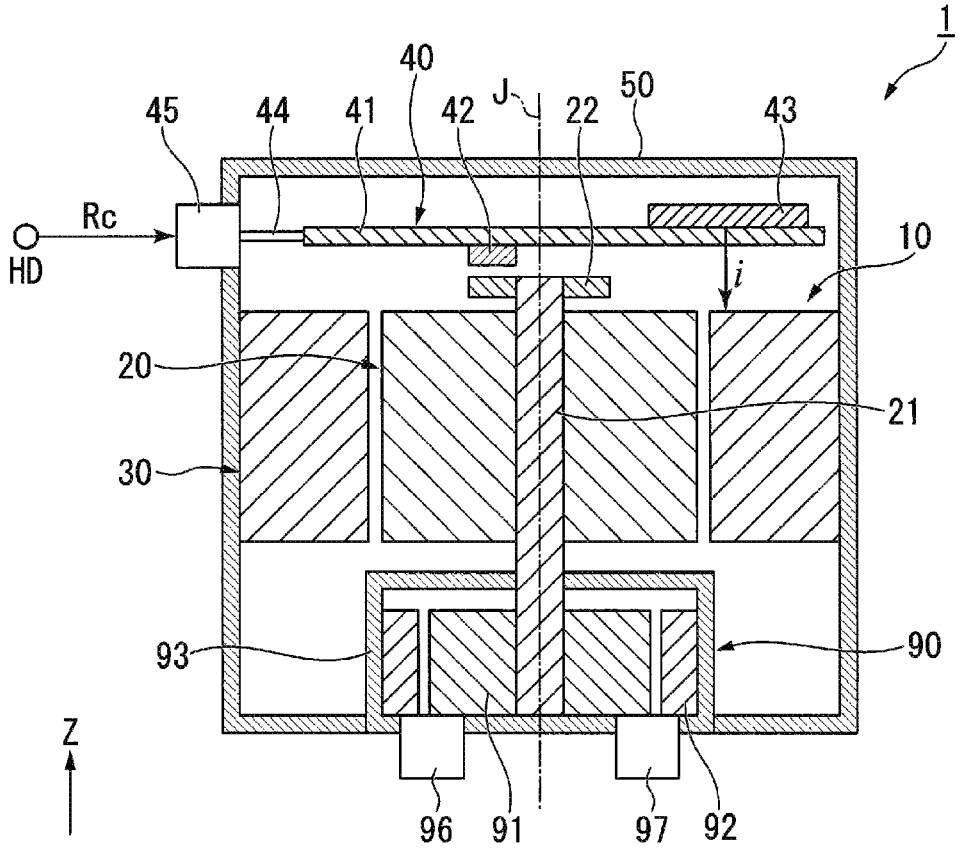
FIG. 1 is a cross-sectional diagram of an electric oil pump.

As shown in FIG. 1, the electric oil pump 1 includes a motor 10, a control board 40, a housing 50, and a pump mechanism 90. In the case of the present embodiment, the housing 50 accommodates the motor 10, the control board 40, and the pump mechanism 90 inside. In the housing 50, the part functioning as a motor housing and the part functioning as a board housing may be separate housing bodies.

The motor 10 includes a rotor 20 and a stator 30. The rotor 20 includes a shaft 21 that extends along the central axis J extending in the vertical direction. An annular sensor magnet 22 is fixed to an upper end of the shaft 21 of the rotor 20 when viewed in the axial direction. A lower end of the shaft 21 is connected to the pump mechanism 90. The stator 30 surrounds the rotor 20 from the outside in the radial direction. An outer circumferential surface of the stator 30 is fixed to the inner circumferential surface of the housing 50. The stator 30 is electrically connected to the control board 40. In the case of the present embodiment, the motor 10 is a three-phase motor.

The control board 40 includes a printed board 41, a rotation sensor 42, a control device 43, an external connection terminal 44, and a connector 45. The printed board 41 extends in a direction orthogonal to the axial direction. The rotation sensor 42 is mounted on a lower surface of the printed board 41. The rotation sensor 42 is, for example, a Hall IC. The rotation sensor 42 faces the sensor magnet 22 in the vertical direction and detects the position in the rotating direction of the shaft 21.

The control device 43 drives and controls the motor 10. The control device 43 includes, for example, a control circuit and a drive circuit. The control circuit calculates a drive current supplied to the motor 10 based on a command value of the rotation speed input from a host device HD. The drive circuit generates a current supplied to the motor 10, which is a three-phase motor, based on the calculation result of the control circuit.

The external connection terminal 44 extends from the printed board 41 to the connector 45. The connector 45 is disposed in a through-hole that penetrates the housing 50 in the radial direction. The outer end of the external connection terminal 44 in the radial direction is located inside the connector 45. Via the connector 45, the external connection terminal 44 is connected to a cable extending from the host device HD. In the control board 40, the external connection terminal 44 is connected to the control device 43. In other words, the control device 43 is connected to the host device HD.

The pump mechanism 90 is located on a lower side of the motor 10 and is driven by the power of the motor 10. The pump mechanism 90 includes an inner rotor 91, an outer rotor 92, a pump housing 93, a suction port 96, and a discharge port 97. The pump mechanism 90 sucks a fluid such as oil from the suction port 96 and discharges the fluid such as oil from the discharge port 97.

In the case of the present embodiment, the pump mechanism 90 has a trochoid pump structure. Each of the inner rotor 91 and the outer rotor 92 has a trochoidal tooth shape. The inner rotor 91 is fixed to the lower end of the shaft 21. As a result, in the electric oil pump 1 of the present embodiment, the rotation speed of the motor 10 and the rotation speed of the pump mechanism 90 are the same. The electric oil pump 1 may be configured to include a speed reduction mechanism between the motor 10 and the pump mechanism 90. The outer rotor 92 is configured outside the inner rotor 91 in the radial direction. The outer rotor 92 surrounds the inner rotor 91 from the outside in the radial direction over the entire circumference in the circumferential direction.

The pump housing 93 accommodates the inner rotor 91 and the outer rotor 92 inside. The shaft 21 penetrates an upper surface of the pump housing 93 and extends into the pump housing 93. The suction port 96 and the discharge port 97 are located on a lower surface of the pump housing 93. The suction port 96 and the discharge port 97 are connected to a space located between the inner rotor 91 and the outer rotor 92.

Figure 2:
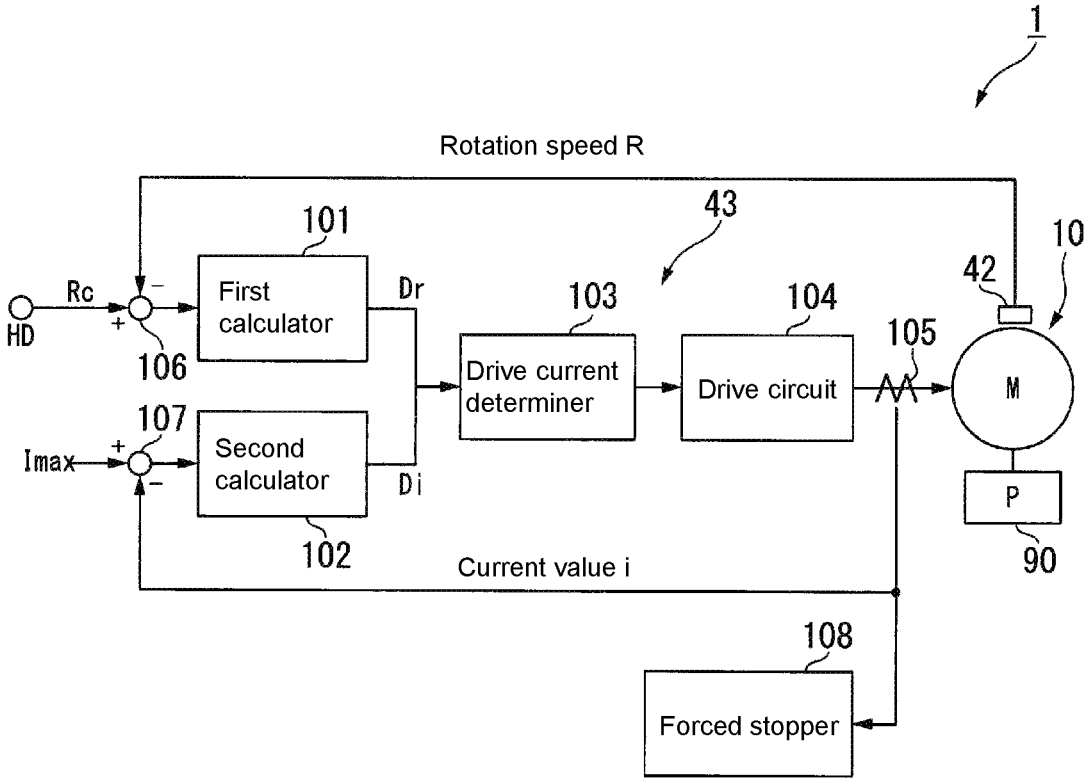
FIG. 2 is a functional block diagram of a control device of the electric oil pump.

As shown in FIG. 2, the control device 43 includes a first calculator 101, a second calculator 102, a drive current determiner 103, a drive circuit 104, a current sensor 105, a subtractor 106, a subtractor 107, and a forced stopper 108. The control device 43 is connected to the host device HD and the motor 10. The host device HD is connected to the first calculator 101 of the control device 43. The motor 10 is connected to the drive circuit 104 of the control device 43.

The control device 43 is connected to the stator 30 of the motor 10. The control device 43 outputs a drive current to a coil of the stator 30 and drives the pump mechanism 90 by rotating the motor 10. In FIG. 2, the drive circuit 104 and the motor 10 are connected by one wiring, but the motor 10 is a three-phase motor and the drive circuit 104 and the motor 10 are actually connected by the respective wirings of U-phase, V-phase, and W-phase. The current sensor 105 is configured for each wiring connecting the drive circuit 104 and the motor 10.

The first calculator 101 calculates a current duty value to be output to the motor 10 based on a deviation between a command value Rc of the rotation speed input from the host device HD and a rotation speed R of the motor 10. Specifically, the control device 43 inputs the rotation speed R of the motor 10 measured by the rotation sensor 42 into the subtractor 106 as feedback. The subtractor 106 outputs the deviation between the command value Rc and the rotation speed R to the first calculator 101. The first calculator 101 calculates a first duty value Dr for feedback control of the motor 10 so that the rotation speed R matches the command value Rc.

The second calculator 102 calculates a current duty value to be output to the motor 10 based on a deviation between a limit value Imax that limits a current value of the motor 10 and a current value flowing in a coil of the motor 10. Specifically, the current sensor 105 is configured between the drive circuit 104 and the motor 10. The current sensor 105 is, for example, a current sensor of a type that uses a shunt resistor.

The control device 43 inputs a current value i measured by the current sensor 105 into the subtractor 107 as feedback. The subtractor 107 outputs the deviation between the limit value Imax and the current value i to the second calculator 102. The second calculator 102 calculates a second duty value Di for feedback control of the motor 10 so that the current value i matches the limit value Imax.

An output terminal of the first calculator 101 and an output terminal of the second calculator 102 are both connected to the drive current determiner 103. In other words, the first calculator 101 and the second calculator 102 are connected in parallel to the drive current determiner 103.

An output terminal of the drive current determiner 103 is connected to the drive circuit 104. The drive current determiner 103 compares the first duty value Dr input to the drive current determiner 103 from the first calculator 101 with the second duty value Di input to the drive current determiner 103 from the second calculator 102. The drive current determiner 103 selects the lower one of the first duty value Dr and the second duty value Di as a current duty value to drive the motor 10. The drive current determiner 103 outputs the selected duty value to the drive circuit 104.

The drive circuit 104 includes an inverter circuit that generates a drive current applied to U-phase, V-phase, and W-phase coils of the stator 30, and a signal generation circuit that generates a PWM (pulse width modulation) signal to be supplied to the inverter circuit. The signal generation circuit generates the PWM signal based on the duty value input from the drive current determiner 103 and outputs the PWM signal to the inverter circuit. The inverter circuit modulates the power supply voltage based on the PWM signal and outputs a signal wave to the motor 10.

Figure 3:
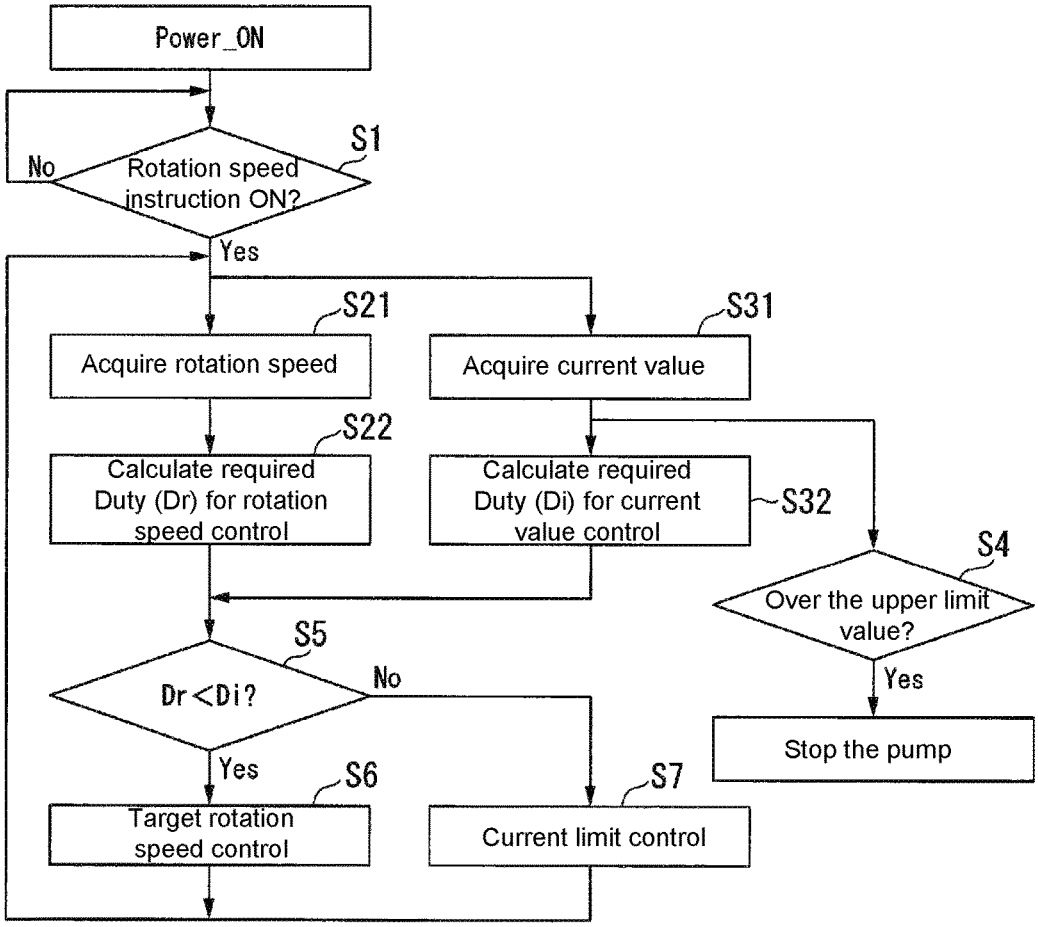
FIG. 3 is a flowchart showing an operation of the electric oil pump.
Figure 4:
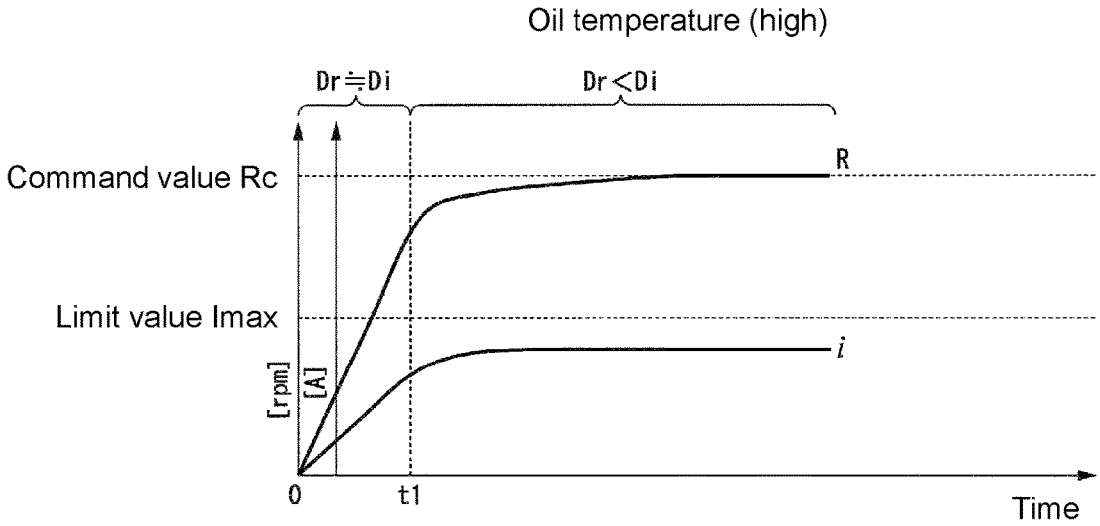
FIG. 4 is an explanatory diagram showing a control state of the electric oil pump.
Figure 5:
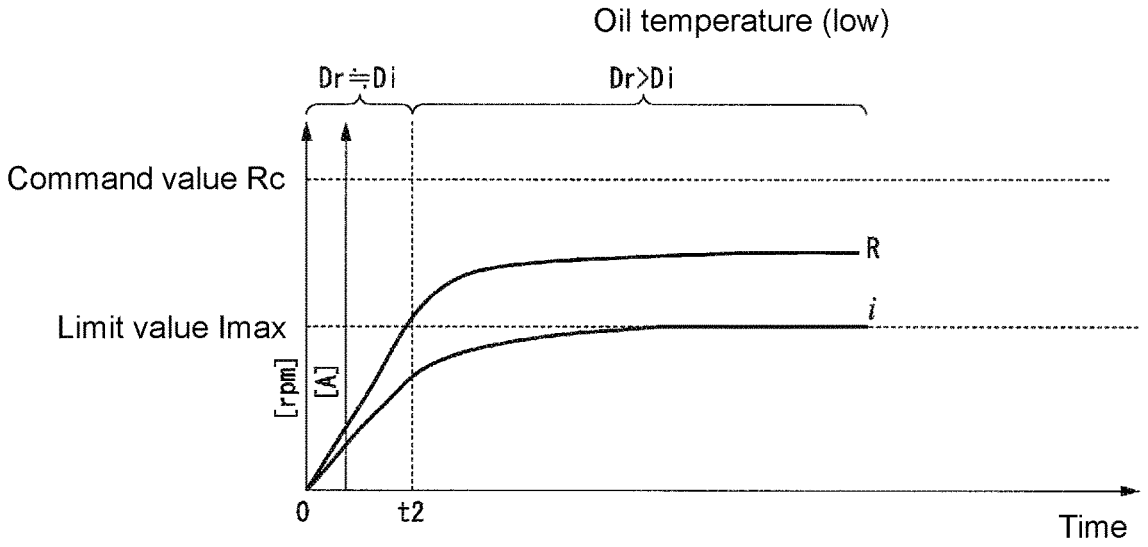
FIG. 5 is an explanatory diagram showing a control state of the electric oil pump.
Figure 6:
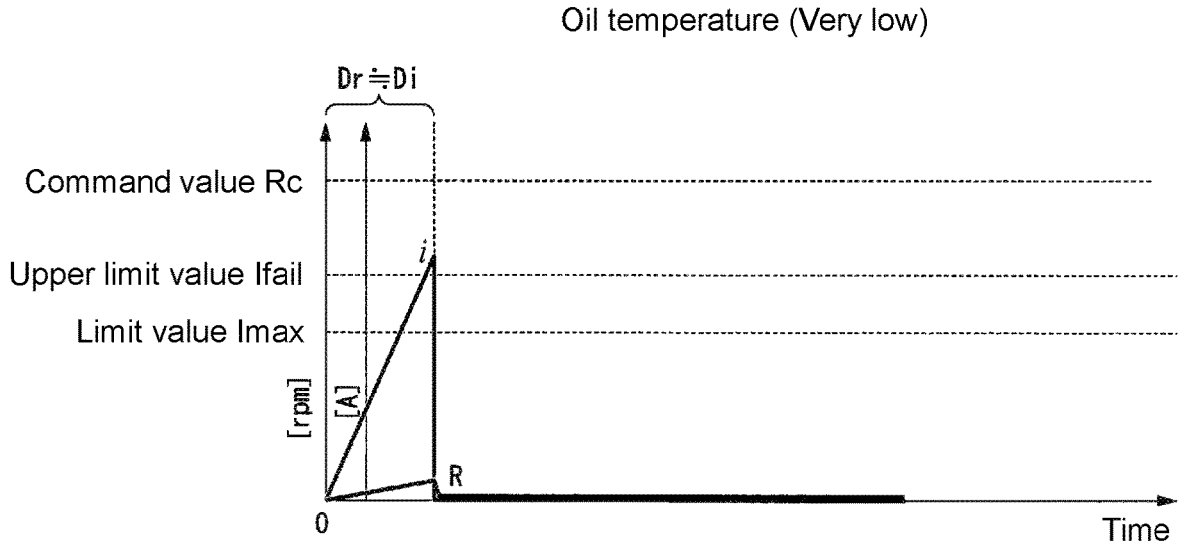
FIG. 6 is an explanatory diagram showing a control state of the electric oil pump.

With reference to FIGS. 3 to 6, below an operation of the electric oil pump 1 is described in detail. FIG. 3 is a flowchart showing the operation of the electric oil pump 1. FIGS. 4 to 6 are diagrams showing changes in the rotation speed and coil current of the motor 10 during the operation of the electric oil pump over time. FIG. 4 shows a case where an oil temperature is high. FIG. 5 shows a case where an oil temperature is low. FIG. 6 shows a case where the electric oil pump is forced to stop.

As shown in FIG. 3, in step S1, the electric oil pump 1 in a power-on state stands by for a command value input from the host device HD. When the command value Rc is input from the host device HD, the control device 43 executes the calculations of the duty values performed by the first calculator 101 and the second calculator 102 in parallel.

In step S21, the control device 43 acquires from the rotation sensor 42 the rotation speed R of the motor 10. In step S22, the subtractor 106 outputs the deviation between the command value Rc and the rotation speed R to the first calculator 101. The first calculator 101 calculates the first duty value Dr based on the deviation between the command value Rc and the rotation speed R. The first calculator 101 calculates the duty value of the drive current to be output to the motor 10 so as to bring the rotation speed R close to the command value Rc. The first calculator 101 outputs the calculated first duty value Dr to the drive current determiner 103.

In step S31, the control device 43 acquires a current value of the drive current to be output to the motor 10 from the current sensor 105. In step 32, the subtractor 107 outputs the deviation between the limit value Imax and the current value i to the second calculator 102. The second calculator 102 calculates the second duty value Di based on the deviation between the limit value Imax and the current value i. The second calculator 102 calculates the duty value of the drive current to be output to the motor 10 so as to bring the current value i close to the limit value Imax. The second calculator 102 outputs the calculated second duty value Di to the drive current determiner 103.

Here, in step S4, the control device 43 inputs the current value i acquired in step S31 to the forced stopper 108. Step S4 is executed in parallel with step S32. The forced stopper 108 determines whether or not the current value i exceeds an upper limit value Ifail of the current. When the current value i exceeds the upper limit value Ifail, the forced stopper 108 stops the motor 10. On the other hand, when the current value i is below the upper limit value Ifail, the forced stopper 108 does not operate.

FIG. 6 is a diagram showing changes in the rotation speed and coil current of the motor 10 when the motor 10 is stopped by the forced stopper 108. As shown in FIG. 6, the upper limit value Ifail is a value large than the limit value Imax. The upper limit value Ifail is a value that may damage the motor 10 when the current value i of the motor 10 constantly exceeds the upper limit value Ifail. On the other hand, the limit value Imax is a maximum value of the current value i at which the motor 10 is able to be safely operated.

A case where the motor 10 is stopped by the forced stopper 108 is, for example, that the oil temperature is very low and therefore the viscosity of the oil is very high and the motor 10 does not rotate due to the load of oil, or that foreign substance enters the pump mechanism 90 and the inner rotor 91 and the outer rotor 92 do not rotate.

When the control device 43 receives input of the command value Rc, the control device 43 attempts to increase the drive current to bring the motor 10 close to the command value Rc. In the process, if the motor 10 is hardly able to be rotated, the current value i rises sharply. Depending on the rising speed of the current value i, the current feedback control based on the limit value Imax may not be performed in time and the motor 10 may be damaged. Therefore, by providing the forced stopper 108, as in the present embodiment, damage to the motor 10 due to a sudden increase in the current value i is able to be suppressed.

In step S5, the control device 43 compares the first duty value Dr and the second duty value Di by the drive current determiner 103. When the first duty value Dr is smaller than the second duty value Di, the process proceeds to step S6. In other words, the first duty value Dr calculated based on the rotation speed R of the motor 10 is input to the drive circuit 104 and the current is supplied from the drive circuit 104 to the motor 10. On the other hand, when the second duty value Di is larger than the first duty value Dr, the process proceeds to step S7. In this case, the second duty value Di calculated based on the current value i of the motor 10 is output to the motor 10. After step S6 or step S7, the process returns to step S21 and step S31 and the operation is repeated.

The difference in operation when the oil temperature is different will be specifically described below. FIG. 4 shows a case where the temperature of the oil conveyed by the electric oil pump 1 is high. When the rotation operation of the electric oil pump 1 is started, the rotation speed R and the current value i of the motor 10 both start to increase. Immediately after the start of rotation, the difference between the rotation speed R and the command value Rc and the difference between the current value i and the limit value Imax are both large. Therefore, the first duty value Dr and the second duty value Di are both relatively large values.

As shown in FIG. 4, when the first duty value Dr and the second duty value Di are substantially the same values, until a time t1 when the rotation speed R increases significantly, in step S5, it is uncertain which of the first duty value Dr and the second duty value Di is selected. Regardless of which of the first duty value Dr and the second duty value Di is selected, the operating state of the motor 10 does not change significantly because the values are substantially the same. Moreover, by adjusting the gains of the first calculator 101 and the second calculator 102, it is possible to ensure that the first duty value Dr is always selected and also possible to ensure that the second duty value Di is selected, during the period up to the time t1.

When the rotation speed R increases to some extent and the deviation from the command value Rc decreases, the first duty value Dr calculated by the first calculator 101 decreases. On the other hand, when the oil temperature is high, the current value i of the motor 10 remains well below the limit value Imax because the viscosity of oil is low and the load on the pump mechanism 90 is small. Therefore, the second duty value Di calculated by the second calculator 102 does not change much from the value immediately after the start of rotation.

As described above, after the time t1 when the rotation speed R is close to the command value Rc, the first duty value Dr becomes smaller than the second duty value Di and the first duty value Dr is selected by the drive current determiner 103. As a result, the increase in the rotation speed R becomes gradual and converges toward the command value Rc. The increase in the current value i also becomes gradual as the rotation speed R changes. When the rotation speed R reaches the command value Rc, the current value i is maintained at a constant value lower than the limit value Imax.

FIG. 5 shows a case where the temperature of the oil conveyed by the electric oil pump 1 is low. When the oil temperature is low, the load on the pump mechanism 90 becomes large due to high oil viscosity, and the drive current to rotate the motor 10 at the rotation speed of the command value Rc increases. The control device 43 of the present embodiment controls the motor 10 so that the current value i of the motor 10 does not exceed the limit value Imax.

As shown in FIG. 5, when the rotation operation of the electric oil pump 1 is started, both the rotation speed R and the current value i of the motor 10 start to increase. The operation immediately after the start of rotation is the same as the case shown in FIG. 4.

When the oil temperature is low, the current value i is more likely to increase and the rotation speed R is less likely to increase than when the oil temperature is high. Therefore, before the rotation speed R comes close to the command value Rc, the current value i becomes close to the limit value Imax and the second duty value Di calculated by the second calculator 102 decreases. At this time, since the difference between the rotation speed R and the command value Rc is still large, the first duty value Dr calculated by the first calculator 101 does not change much from the value immediately after the start of the rotation.

As described above, after a time t2 when the current value i comes close to the limit value Imax, the second duty value Di becomes smaller than the first duty value Dr and the second duty value Di is selected by the drive current determiner 103. As a result, the increase in the current value i becomes gradual and converges toward the limit value Imax. The increase in the rotation speed R also becomes gradual as the current value i changes. When the current value i reaches the limit value Imax, the rotation speed R is maintained at a constant value lower than the command value Rc. The value at which the rotation speed R converges varies depending on the oil temperature and becomes lower as the oil temperature becomes lower.

However, since the second calculator 102 of the control device 43 calculates the second duty value Di based on the deviation between the current value i of the motor 10 and the limit value Imax, the second duty value Di is always a value greater than zero. In other words, the control device 43 does not stop the motor 10 as much as possible even in a low temperature environment where the motor 10 is unable to be rotated by the command value Rc.

As described above, according to the control device 43 of the present embodiment, since the duty value of the lower one of rotation speed control and current limit control is selected, when the oil temperature is low and the load of the motor 10 is excessively large, the current value i is switched to the current limit control when coming close to the limit value Imax so that the rotation speed is not forcibly increased. Therefore, the motor 10 is able to be operated safely depending on the state of the motor 10 without measuring the oil temperature. In the current limit control, since the motor 10 is driven at the limit value Imax that allows the motor 10 to operate safely, the electric oil pump 1 is able to be operated by turning the motor 10 as much as possible even in a low temperature environment.

Features of the above-described preferred embodiments and the modifications thereof may be combined appropriately as long as no conflict arises. While preferred embodiments of the present disclosure have been described above, it is to be understood that variations and modifications will be apparent to those skilled in the art without departing from the scope and spirit of the present disclosure. The scope of the present disclosure, therefore, is to be determined solely by the following claims.

What is claimed is:

1. A control device of an electric oil pump, controlling a rotation speed of the electric oil pump, which comprises a motor and a pump mechanism connected to the motor, based on a command value that is input from a host device, wherein the control device of the electric oil pump comprises:

a first calculator calculating a first duty value of current to be output to the motor based on a deviation between the command value that is input from the host device and a rotation speed of the motor;

a second calculator calculating a second duty value of current to be output to the motor based on a deviation between a current limit value of the motor and a current value of the motor; and a drive current determiner comparing the first duty value of current calculated by the first calculator and the second duty value of current calculated by the second calculator, and selecting a lower value of one of the first duty value of current and the second duty value of current as a duty value of current that drives the motor.

2. The control device of the electric oil pump according to claim 1, comprising a forced stopper that stops the motor when the current value of the motor exceeds a predetermined current upper limit value.

3. The control device of the electric oil pump according to claim 1, wherein the second duty value of current is a value greater than zero.

4. The control device of the electric oil pump according to claim 3, comprising a forced stopper that stops the motor when the current value of the motor exceeds a predetermined current upper limit value.

5. An electric oil pump, comprising:

a motor; and a control device comprising:

a first calculator calculating a first duty value of current to be output to the motor based on a deviation between a command value and a rotation speed of the motor, wherein the command value is input from a host device;

a second calculator calculating a second duty value of current to be output to the motor based on a deviation between a current limit value of the motor and a current value of the motor; and a drive current determiner comparing the first duty value of current calculated by the first calculator and the second duty value of current calculated by the second calculator, and selecting a lower value of one of the first duty value of current and the second duty value of current as a duty value of current that drives the motor.

* * * * *